United States Patent [19]

Schirmer

[11] 4,155,209

[45] May 22, 1979

[54] FLUID-SEALED SHEET METAL JOINT

[76] Inventor: Carl L. Schirmer, 25078 Franklin Dr., Idyllwild, Calif. 92349

[21] Appl. No.: 892,904

[22] Filed: Apr. 3, 1978

[51] Int. Cl.[2] ..... B04D 13/00

[52] U.S. Cl. ..... 52/417; 52/468; 52/573

[58] Field of Search ..... 52/468, 422, 465, 394, 52/395, 522, 461, 573, 417

[56] References Cited

U.S. PATENT DOCUMENTS

| | | | |
|---|---|---|---|
| 2,126,499 | 8/1938 | Petersen | 52/468 |
| 2,532,466 | 12/1950 | Stemmons | 52/465 |
| 3,332,711 | 7/1967 | Holly | 52/468 |
| 3,474,585 | 10/1969 | Foster | 52/394 |
| 3,583,113 | 8/1971 | Winski | 52/461 |

*Primary Examiner*—John E. Murtagh

*Attorney, Agent, or Firm*—Donald D. Mon

[57] ABSTRACT

A fluid-sealed sheet metal joint includes a first and second sheet each having an edge with a turned-under flange. A clip includes a base with two parallel edges with a turned-over flange along each of these edges. A core has a cap with two parallel edges, and along each of these edges a U-shaped flange. This structure is assembled with various of the flanges overlapping and flattened to create a fluid sealing joint. Preferably there is also an elastomeric sealant in the joint.

19 Claims, 6 Drawing Figures

FLUID-SEALED SHEET METAL JOINT

This invention relates to a fluid-sealed sheet metal joint, and in particular to a joint suitable for joining sheets of metal to form a roof. For example, the roof of a mobile home, of a prefabricated building, and of farm and industrial buildings generally.

Sheet metal roofs are surprisingly difficult to construct reliably and leak-proof. It is customary to build them from relatively thin sheet metal in order to keep the cost within tolerable limits. However, when this is done, the problems of joining edges of adjacent sheets so that there is no leak at the joint become very severe. Soldered and welded joints are usually too expensive, and therefore crimped joints are more frequently utilized. Attempts have been made to utilize fluid sealing fasteners and sealants between overlapping surfaces, but these usually leak rather soon, these leaks often being caused by cycling forces exerted as a consequence of the rising and falling temperatures to which roofs are subjected. The roof goes from a colder temperature at night to a hotter temperature during the daytime, and the resulting stresses soon work on sealing fasteners, overlapped sealed joints, and conventional crimped joints to loosen them and permit leakage.

One of the reasons for the loosening of a conventional crimped and rolled joint is the lateral pull on the joint caused by the temperature changes. These create an eccentric loading which tends gradually to loosen and weaken the joint so that leakage occurs.

It is an object of this invention to provide a fluid-sealing joint which is crimped and rolled, and which may or may not utilize a sealant, but which is so constructed that lateral pull on the joint does not result in deleterious eccentric loads. The term "fluid-sealed joint" is used herein to define a joint which resists the leakage of water through it.

A fluid-sealed joint according to this invention comprises a first and a second sheet each of which has a turned-under flange. A clip is provided with a base and two parallel edges, and along each of the edges there is a turned-over flange. A core includes a cap with two parallel edges, and along each of the edges there is a U-shaped flange. These four elements are assembled and flattened against one another to form the fluid-sealed joint of the invention.

According to a preferred but optional feature of the invention, a bead of sealant can be laid down to make a fluid-sealing contact between the sheet and one of the other elements further to resist leakage.

According to still another preferred but optional feature of the invention, each sheet is provided with a groove which relieves at least some of the lateral forces which otherwise would be exerted on the joint, thereby reducing fatigue effects on the joint.

The above and other features of this invention will be fully understood from the following detailed description and the accompanying drawings, in which.

Figure 1:
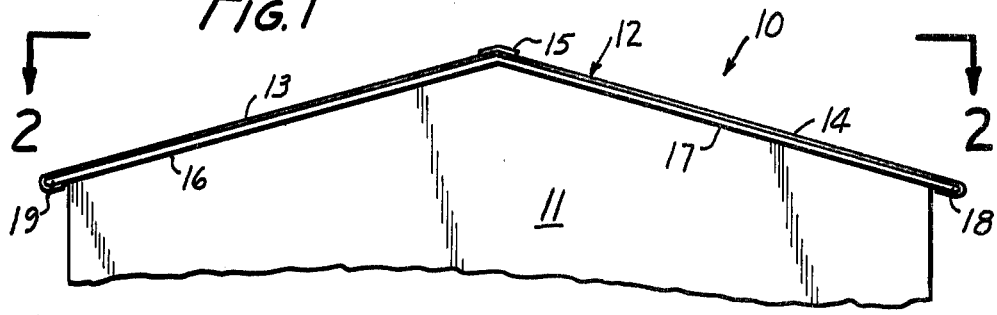
FIG. 1 is an end elevation of a mobile home showing the environment in which this invention finds its best use.

FIG. 1 shows an elevation of a mobile home 10. The end wall 11 is shown with a peaked roof 12 having two primary roof surfaces 13, 14. A ridge cap 15 extends along the central axis of the roof, and protects against leakage between the primary surfaces are shown laid atop substructures 16, 17 which might be such as plywood sheets or otherwise, and are shown rolled around the over-hangs 18, 19 of substructures 16 and 17. Usually the primary surfaces are nailed to the substructure beneath the overhang.

The structure utilized at the ridge maybe any known structure in the art, and requires no detailed description here.

This invention provides a joint used in each of the primary surfaces 13 and 14. Surfaces 13 and 14 are separate from one another, and each comprises a plurality of flat sheets, for example of aluminum. Of course, other materials may be used such as galvanized iron, but an advantage of this invention is that aluminum, which is resistant to oxidation can be utilized to form a reliable structure with a considerable life.

Because primary surfaces 13 and 14 are identical, only primary surface 14 will be described in detail, it being understood that both primary surfaces will be alike.

Figure 2:
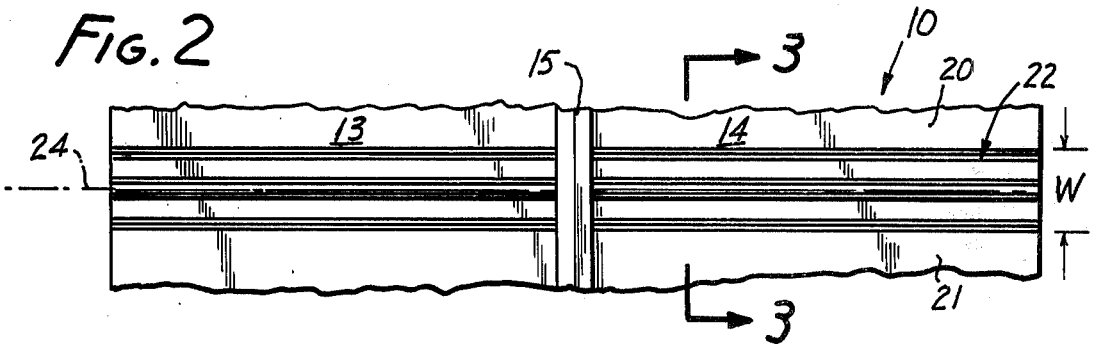
FIG. 2 is a fragmentary top view taken at line 2—2 in FIG. 1.
Figure 3:
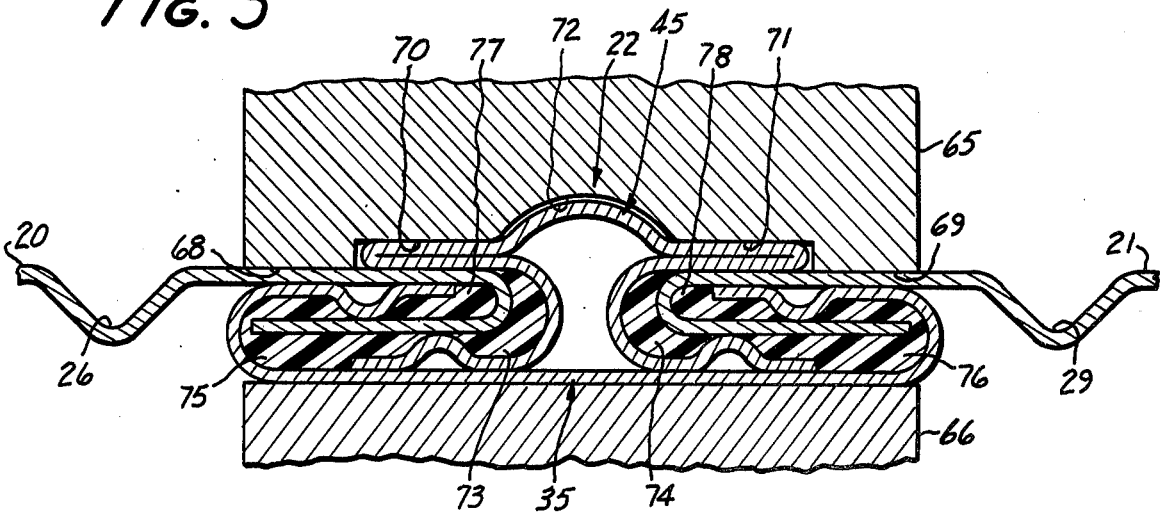
FIG. 3 is a cross-section taken at line 3—3 in FIG. 2 also showing tooling for making the joint.

There is shown in FIGS. 2 and 3 a first sheet 20 and a second sheet 21 held together by a joint 22 according to the invention. There will be as many of these joints as required in order to assemble as long a roof as desired from sheets of available width. Therefore joint 22 is exemplary of one of many joints, and is shown much larger than true scale in FIG. 2. In practice, the width W of the joint will be on the order of only about two inches when assembling sheets of aluminum approximately 0.021 inches thick.

Figure 4:
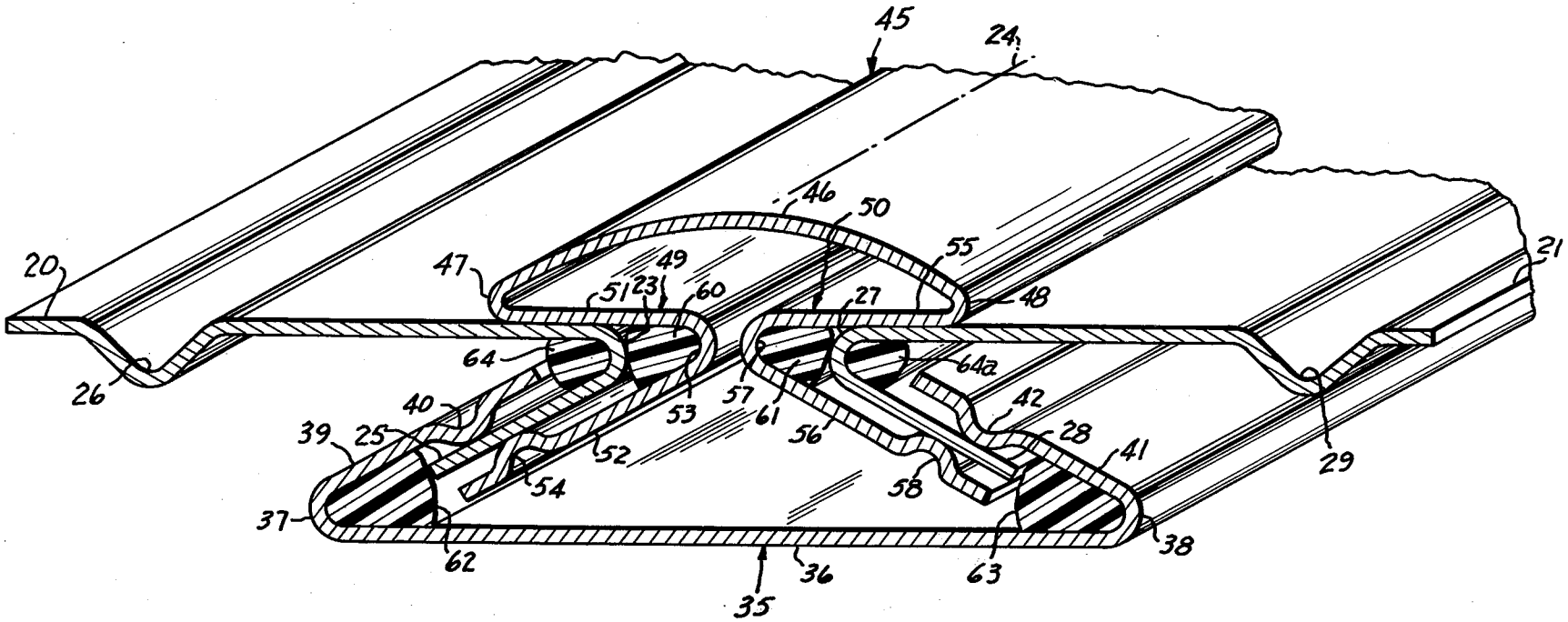
FIG. 4 shows a preassembly of the joint.

The joint 22 is shown in its preassembled condition in FIG. 4, and in its assembled condition in FIG. 3. Accordingly, reference will first be made to FIG. 4. First sheet 20 has an edge 23 which extends parallel to longitudinal axis 24 of the joint. This axis is normal to the ridge cap. This edge 23 has a first turned-under flange 25. Sheet 20 also has a stress-relieving groove 26 extending parallel to the edge. In the preassembly, the turned-under flange makes an angle of about 30° with the sheet itself.

Second sheet 21 has an edge 27 parallel to axis 24, and a second turned-under flange 28. A stress-relieving groove 29 extends parallel to edge 27. Second turned-under flange 28 in the preassembly makes about a 30° angle with the sheet.

A clip 35 includes an imperforate base 36 with two parallel edges 37 and 38. Along the first parallel edge 37 there is a first turned-over flange 39. There is an optional axially extending bead 40 formed by rolling which extends inwardly in the clip as it extends axially along the clip. At the second edge 38 there is a second turned-over flange 41 and an optional bead 42 both extending parallel to the edge and the axis. Both flanges 39 and 42 overhang the base at about 30°.

A core 45 includes an imperforate cap 46 with a first and second edge 47, 48, respectively, extending parallel to each other and to axis 24. In the preassembled condition the cap 46 is crowned from edge 47 to edge 48. The core includes a first U-shaped flange 49 extending from edge 47, and a second U-shaped flange 50 extending from edge 48. First U-shaped edge 49 has a first upper arm 51 and a first lower arm 52, and between those two arms a first bight 53. There is an optional axially-extending bead 54 rolled into the lower arm directed toward the turned-under first flange 25.

Second U-shaped flange 50 includes a second upper arm 55, a second lower arm 56, and between those two arms a second bight 57. An optional axially-extending bead 58 is formed in the second lower arm 56, directed toward the second turned under flange 28.

In the loose unassembled condition shown in FIG. 4 it is evident that the joint can be preassembled by simply sliding the clip and core into position as shown with their respective lower arms and turned-over flanges embracing the turned-under flanges of the sheets. It will be understood that all of the elements heretofore described extend for the full length of the joint without any perforations in them.

As will later be shown, the joint will be compressed so that there is full metal-to-metal contact between the various elements. This resulting joint will often be suitably fluid-tight. However, an improved and even more reliable joint can be otained by the use of sealant in various locations. In FIG. 4, for example, sealant beads 60, 61 are shown deposited in respective bights 53 and 57. These are of dimensions that will not interfere with the preassembly, and which can be laid down by extrusion or by the pressing in of a bead. A convenient way to deposit the sealant is to lay down a room temperature vulcanizing elastomeric sealant in the bight by extruding it through a nozzle. Conveniently, this elastomer might be a seven-day cure time composition such as 3M No. 5200, and be left to partially cure to a semi-solid condition for about one day before the joint is fully completed. This will assure that the sealant remains in place, and it will still be sufficiently viscous to flow and make contact with and adherently cure against the adjoining surfaces.

Additional sealant beads 62, 63 can be laid down in the angle formed between the turned-over flange and the base in the clip, having the same relative dimensions and properties of the other beads.

Still other sealant beads **64, 64*a* can be laid down in the angle formed between sheets 20 and 21 and their respective turned-under flanges 25 and 28**.

There preferably should be at least one sealant bead adjacent to each of the sheets. It is unimportant at which location it is provided. Optimum protection against leakage will be provided when sealant beads are used in two or three locations at each edge of the joint.

The assembly of this joint is elegantly simple. After the sealants (if used) have partially cured, the four parts are slid together along the axis to the position shown in FIG. 4. Then die parts 65, 66 shown in FIG. 3 are rolled along the preassembly. The lower die part 66 might be a table or a roller as preferred. It is intended to constitute a bottom support for the joint where it is being deformed flat. Die part 65 is a form roller which includes a pair of cylindrical surfaces 68, 69, and at their edges a pair of cylindrical stepped surfaces 70, 71. A crowned surface 72 is formed between surfaces 70 and 71.

As the die is rolled along the joint, the metal is deformed to flatten the joint. This can be done in one or several steps, using progressive dies if desired. The pressure exerted will cause the previous 30° bends to go to full 180° bends, and the metal surfaces to contact one another. The deformation should be such as to preclude substantial springback, and the softer the sheet material, the less the tendency to springback will be. Thus, a reasonably fluid-sealing joint can be made even without a sealant especially when a smoother surfaced metal is being used. However, to provide an even more reliable joint which is certainly desirable in roofs, and for making a good fluid-seal when the surfaces of the sheets are textured, one two, or all three of said sealants may be provided adjacent to each one of the sheets. The volume of the beads is selected so that when the metal is distorted as shown, the sealant will flow so as to make substantial surface-to-surface adherent contact with the various adjacent surfaces. For example, the material of the upper beads 60, 61 flows to fill chambers 73, 74. The material of the lower beads 62, 63 flows to fill chambers 75, 76, at least to the extent of extending across them and forming a barrier to lateral leakage through those chambers. The material of beads 64 and **64*a* flows to contact the bend in the respective sheet and the adjacent turned-over flange to fill chambers 77, 78**.

The size and shape of the beads before deformed will be selected to achieve this objective. It is not necessary that the chambers be completely filled but a better assembly is made if it does.

Figure 5:
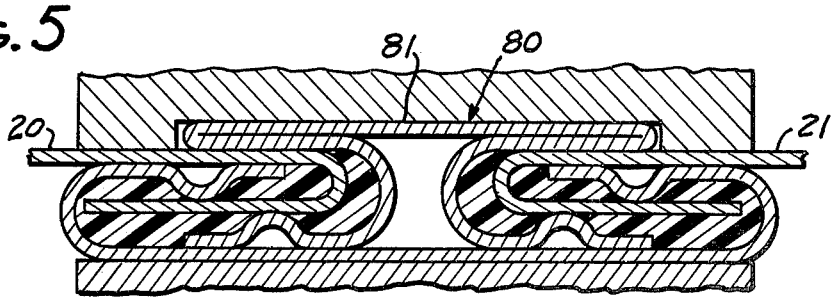
FIG. 5 shows another embodiment of the invention.

In FIG. 5 there is shown a joint 80 which is all ways identical to joint 22, with the exception that the center surface is a flat surface 81 instead of a crowned surface. There may be some installations where the crown is less desirable and this shows that it is unnecessary to the invention.

Figure 6:
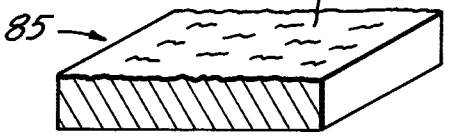
FIG. 6 shows a textured sheet which can be utilized with this invention.

In FIG. 6, a metal sheet 85 is shown with an embossed surface 86 thereon. This is an irregular surface put on metal sheets to simulate roughness such as stucco. To make a fluid-seal with it would require considerable deformation of metal on the surface. The use of sealants makes such an arrangment unnecessary. Sealant simply flows into the irregularities and makes the seal.

This invention thereby provides an elegant and reliable fluid-sealing joint between a pair of metal sheets. Used in a roof the joint can be expected to have a long and useful life. It will be noted that when a lateral tensile force is exerted on the joint, there is no tendency for the joint to "peel apart". Instead, opening up of the joint is resisted by the clamping force exerted by the U-shaped flanges of the cap. Further, it will be seen that there are barriers to the leakage of water through the joint, because the core is imperforate and because the potential fluid passage between the upper arms and the sheets is impeded not only by the metal-to-metal contact, but by the sealant, when used, thereafter by the metal-to-metal contact between the lower arms and the turned-under flanges, thereafter by the next sealants if used, thereafter by the metal-to-metal contact between the turned-over flanges and the sheets. This is indeed a tortuous and difficult path for water to take even if there were no sealants. If there were sealant anywhere in the path, leakage is a total impossibility.

Although only one expansion groove 26, 29 is shown in each sheet, more than one may be provided to reduce the expansion and contraction required of each groove, or to increase the capacity of the sheet to expand and contract.

Also, while this joint is shown and described in use extending normally to the ridge cap, it is to be understood that it can run parallel to it instead, and can be used to join sheets at edges parallel to it, and for that matter, on three or four sides. In addition, this joint is useful for other than roof applications. It is useful where ever a fluid-sealed joint is needed.

This invention is not be limited by the embodiments shown in the drawings and described in the description which are given by way of example and not of limitation, but only in accordance with the scope of the appended claims.

I claim:

1. A fluid-sealed sheet metal joint having an axis and comprising:

a first sheet having an edge, and along said edge a first turned-under flange;

a second sheet having an edge, and along said edge a second turned-under flange;

a clip having a base with two parallel edges, and along a first of said edges a first turned-over flange, and along the second of said edges, a second turned-over flange; and a core having a cap with two parallel edges, and along a first of said edges a first U-shaped flange, and along the second of said edges a second U-shaped flange, said U-shaped flanges having respective first and second bights, and first and second upper and lower arms, said first and second turned-under flanges being disposed between the respective first and second turned-over flanges and the first and second lower arms;

said first and second turned-over flanges being disposed between the respective first and second sheets and the first and second turned-under flanges;

said first and second lower arms being disposed between said first and second turned-under flanges and said base;

said first and second upper arms respectively bearing against said first and second sheets, said joint being pressed flat at least adjacent to the edges of the cap, the cap and upper arms being flat against each other, and the upper and lower arms, the sheets, the turned-under and turned-over flanges and the clip base adjacent its edges all being substantially parallel, whereby the parts recited as disposed relative to one another are in contact with one another along at least respective lines of contact parallel to the said edges.

2. A sheet metal joint according to claim 1 in which one of said turned-over flanges and lower arms bears an axially-extending bead in contact with the respective turned-under flanges.

3. A sheet metal joint according to claim 1 in which each of said sheets includes an axially-extending expansion groove.

4. A sheet metal joint according to claim 1 in which a first and second axially-extending sealant bead make a continuous contact between said first and second turned-under flanges and said first and second U-shaped flanges.

5. A sheet metal joint according to claim 1 in which a first and a second axially-extending sealant bead make a continuous contact between said clip and said turned-under flanges.

6. A sheet metal joint according to claim 1 in which a first and a second axially extending sealant bead make a continuous contact between the first and second turned-under flanges and the first and second turned-over flanges, respectively.

7. A sheet metal joint according to claim 1 in which the cap is crowned between its flattened portions.

8. A sheet metal joint according to claim 1 in which the cap is flattened from edge to edge.

9. A sheet metal joint according to claim 1 in which the turned-under flanges, turned-over flanges, and upper and lower arms are substantially parallel to one another.

10. A sheet metal joint according to claim 1 in which both sides of the sheets are smooth.

11. A sheet metal joint according to claim 4 in which one side of each of the sheets is textured.

12. A sheet metal joint according to claim 5 in which one side of each of the sheets is textured.

13. A sheet metal joint according to claim 6 in which one side of each of the sheets is textured.

14. A sheet metal joint according to claim 2 in which each of said sheets includes an axially-extending expansion groove.

15. A sheet metal joint according to claim 14 in which the cap is crowned between its flattened portions.

16. A sheet metal joint according to claim 14 in which the cap is flattened from edge to edge.

17. A sheet metal joint according to claim 3 in which a first and second axially-extending sealant bead make a continuous contact between said first and second turned-under flanges and said first and second U-shaped flanges.

18. A sheet metal joint according to claim 3 in which a first and a second axially-extending sealant bead make a continuous contact between said clip and said turned-under flanges.

19. A sheet metal joint according to claim 3 in which a first and second axially-extending sealant bead make a continuous contact between the first and second turned-under flanges and the first and second turned-over flanges, respectively.

* * * * *